US009550088B2

(12) United States Patent
Coompol

(10) Patent No.: US 9,550,088 B2
(45) Date of Patent: Jan. 24, 2017

(54) EXERCISE ROLLER

(71) Applicant: Boonplook Coompol, New York, NY (US)

(72) Inventor: Boonplook Coompol, New York, NY (US)

( * ) Notice: Subject to any disclaimer, the term of this patent is extended or adjusted under 35 U.S.C. 154(b) by 0 days.

(21) Appl. No.: 14/702,603

(22) Filed: May 1, 2015

(65) Prior Publication Data

US 2015/0343256 A1 Dec. 3, 2015

Related U.S. Application Data

(60) Provisional application No. 62/003,496, filed on May 27, 2014.

(51) Int. Cl.

| | |
|---|---|
| ***A63B 21/06*** | (2006.01) |
| ***A63B 21/075*** | (2006.01) |
| ***B65D 71/06*** | (2006.01) |
| ***A63B 21/072*** | (2006.01) |

(52) U.S. Cl.

CPC ..... *A63B 21/075* (2013.01); *A63B 21/0722* (2015.10); *A63B 21/0724* (2013.01); *A63B 21/0726* (2013.01); *B65D 71/06* (2013.01); *A63B 21/0605* (2013.01); *A63B 2210/00* (2013.01); *A63B 2210/50* (2013.01)

(58) Field of Classification Search

CPC ..... A63B 21/004; A63B 21/00058; A63B 21/00065; A63B 21/06; A63B 21/0601; A63B 21/0604; A63B 21/0605; A63B 21/0607; A63B 21/062; A63B 21/0626; A63B 21/0628; A63B 21/0632; A63B 21/065; A63B 21/072; A63B 21/0722; A63B 21/0724; A63B 21/0726; A63B 21/0728; A63B 21/075; B65D 71/06; B65D 45/16

USPC ..... 190/20, 315.1; 482/109; 220/504, 503, 220/507, 524, 553, 554, 916, 772, 770, 761, 220/763, 324, 555, 288; 206/315.1

See application file for complete search history.

(56) References Cited

U.S. PATENT DOCUMENTS

| | | | | |
|---|---|---|---|---|
| 850,964 | A * | 4/1907 | Pelletier et al. | A63B 21/075 482/108 |
| 3,758,109 | A * | 9/1973 | Bender | A63B 21/0605 446/241 |
| 4,529,198 | A * | 7/1985 | Hettick, Jr. | A63B 21/0728 482/104 |
| 4,643,302 | A * | 2/1987 | Baumgardner | A45C 3/00 190/105 |
| 5,417,635 | A * | 5/1995 | Sell | A63B 21/065 482/105 |
| 7,216,508 | B2 | 5/2007 | Kretchmer et al. | |

(Continued)

FOREIGN PATENT DOCUMENTS

| | | |
|---|---|---|
| WO | WO2013001314 A2 | 1/2013 |

*Primary Examiner* — Loan H Thanh
*Assistant Examiner* — Megan Anderson
(74) *Attorney, Agent, or Firm* — Winston & Strawn LLP

(57) ABSTRACT

The present invention provides an improved exercise roller apparatus having a cylindrical body with at least one unobstructed inner compartment and wrapped in a foam sleeve. The hollow compartment(s) may hold variable amounts of weights in a fixed position such that the weights do not shift while the roller is in use and the roller rolls steadily on a smooth surface. The foam sleeve provides the cushion necessary to comfortably roll the body over the roller during therapeutic roller use or roller-aided exercises. Handgrips are provided on the body to transform the roller into a versatile weight-lifting apparatus.

20 Claims, 4 Drawing Sheets

(56) References Cited

U.S. PATENT DOCUMENTS

| | | | | |
|---|---|---|---|---|
| 7,758,477 | B2 * | 7/2010 | Prenatt | A63B 21/0603 215/379 |
| 8,231,511 | B2 * | 7/2012 | Dalcourt | A63B 21/0607 482/106 |
| 8,276,351 | B1 * | 10/2012 | Henkin | A63B 21/00058 482/89 |
| 8,500,663 | B2 | 8/2013 | Godfrey et al. | |
| 8,556,837 | B1 | 10/2013 | Poirier | |
| 8,951,172 | B2 * | 2/2015 | Marcus | A63B 21/075 482/106 |
| 2004/0063554 | A1 * | 4/2004 | Wince | A63B 21/0724 482/108 |
| 2005/0187075 | A1 * | 8/2005 | Bellamy | A63B 21/0004 482/93 |
| 2006/0116256 | A1 * | 6/2006 | Carney | A63B 21/0724 482/106 |
| 2006/0160675 | A1 * | 7/2006 | Brown | A63B 21/0605 482/93 |
| 2011/0263392 | A1 * | 10/2011 | Yu | A63B 21/072 482/93 |
| 2011/0300995 | A1 | 12/2011 | Castiglione | |
| 2013/0072357 | A1 * | 3/2013 | Galvan | A63B 69/34 482/83 |
| 2014/0045658 | A1 * | 2/2014 | Hallo | A63B 21/0724 482/93 |
| 2015/0051053 | A1 * | 2/2015 | Conen | A63B 21/0603 482/108 |

* cited by examiner

EXERCISE ROLLER

This application claims the benefit of application No. 62/003,496 filed May 27, 2014, the entire content of which is expressly incorporated herein by reference thereto

BACKGROUND OF THE INVENTION

The present invention generally relates to a physical exercise apparatus and, more specifically, to an apparatus that improves upon exercise rollers by adding more versatility and enhanced utility in physical fitness training activities such as muscle building exercises, stretching, and massage therapy.

Conventional exercise rollers are used in exercises in physiotherapy, Pilates, yoga, and rehabilitation. They are typically solid foam structures with a smooth surface and are available in variety of hardnesses, depending on the desired result and/or the particular preference of a user. Conventional exercise rollers are ideal for stretching exercises and can help improve stability and flexibility of the user and are useful for assisting with core strength and balance training.

Foam exercise rollers have recently become popular outside of the personal training and physical therapy realms and are now being used to assist people in training and exercising on their own. As such, there is a need for exercise rollers that provide users with a broader range of exercise options as well as easy portability. The present invention aims to provide exercise rollers that are portable whole body exercise tools for multiple purpose use as a core fitness development apparatus, an accessory to general fitness, and a therapeutic and/or rehabilitative aid. Such an apparatus can aid with general stretching, body rolling, and balance training, while also including features that enable users to perform muscle-building exercises, such as deadlifts or weight-assisted core-strengthening exercises, or specific sports-related exercises, such as golf exercises, tennis exercises, volleyball exercises, or sailing exercises.

The concept of designing exercise rollers for personal use is not new. However, none of the prior art provides a whole body exercise tool as described above. For example, the following consumer products and patents/patent applications are examples of various exercise roller apparatuses currently known in the art:

- The ProUnit Performance Trainer, as described at http://www.exercisewithafoamroller.com/, is a currently-marketed exercise roller that is used for a broad range of exercises. This device has handles on either end of the roller, but cannot be used to effectively perform weightlifting activities, such as deadlifts.
- OPTP is a manufacturer of foam exercise rollers, such as the OPTP Mobil-izer™ Roll, which has an outer foam layer and a solid PVC core.
- WO2013001314 discloses a physical exercise apparatus comprising a hollow cylindrical device having first and second end caps, at least one of which is removable from its respective end region, which enclose a hollow space in which other exercise tools may be stored. The roller itself is of a fixed weight.
- Poirier, U.S. Pat. No. 8,556,837 B1, discloses a therapeutic roller apparatus that includes soft foam material sleeve that is mounted about a rigid plastic roller that contains a vibration assembly. The vibration assembly includes a weight and motor together, which provide a vibratory effect when operated that is transferred through to the outer soft foam material sleeve.

- Godfrey et al., U.S. Pat. No. 8,500,663 B2, discloses a vibrating massage roller similar to Poirier, but emphasizes the design of the vibrational assembly (i.e., an assembly utilizing a plurality of supports and eccentric weights).
- Castiglione, U.S. Pat. App. No. 2011/0300995, discloses a foam roller comprised of at least two sub exercise roller units connected together to form a single exercise roller and separable to be usable as separate exercise rollers.

The exercise rollers described above are generally useful but do not disclose the improved features of the present invention. Therefore, the present invention now satisfied a need in the art for compact, portable exercise rollers that provide (1) easy weight adjustments between exercises, (2) a storage compartment for securing additional weights, (3) a configuration that aids in the performance of many common weightlifting exercises, and (4) easy portability for exercising at home, with a trainer, or on-the-go.

SUMMARY OF INVENTION

The present invention provides an improved exercise roller apparatus comprising an adjustable weighting component comprising one or more dumbbells or donut weights that provide additional weight of about 2.5 to 55 pounds to the apparatus; a rigid cylindrical body defining an unobstructed chamber configured and dimensioned to receive the dumbbell(s) or some of donut weight(s) therein; a foam material surrounding at least a portion of the cylindrical body; and a first removable end cap on one end of the cylindrical body. Advantageously, the first end cap houses one donut weight and includes a rigid cylindrical support rod extending into the chamber from the end cap, with the support rod configured and dimensioned for supporting additional donut weights in the chamber to provide the adjustable weighting component.

Preferably, the exercise roller apparatus further comprises a second removable end cap on the other end of the cylindrical body, wherein the second end cap houses one donut weight and includes a rigid cylindrical support rod extending into the chamber from the end cap, with the support rod configured and dimensioned for supporting additional donut weights in the chamber so that the adjustable weighting component provides additional weight of at least 5 pounds to the apparatus. In this arrangement, the first and second end caps each have one donut weight affixed thereto, and the adjustable weighting component includes a selectable plurality of donut weights, each of which includes one or more magnets on an outer surface thereof so that the donut weights are magnetically attracted to each other to hold the weights against the end cap, with the donut weights provided on the support rod of the first end cap, the support rod of the second end cap or on both support rods.

To provide additional support to the center of the apparatus, a central partition that divides the chamber into first and second unobstructed chambers is provide, so that each end of the body can include a removable end cap that houses one donut weight and includes a rigid cylindrical support rod extending into the chamber from the end cap. Also, the entire outer surface of the cylindrical body and including the cylindrical surface of the end cap preferably includes foam material.

To attach the end cap to the body, the first end cap includes two spaced catches and the cylindrical body includes two correspondingly spaced recesses each with a draw latch for removable connection of the first end cap to the cylindrical body by engagement of the latches and catches. In this embodiment, the foam material would not be provided on the recesses.

Alternatively, the first end cap may be threadedly engaged with the end of the cylindrical body, with the adjustable weighting component including one or more dumbbells and with the support rod holding the dumbbell in place in the chamber.

The exercise roller apparatus further comprises at least one handgrip assembly affixed to the cylindrical body such that the entire weight of the apparatus may be supported by a user gripping the handgrip assembly, wherein the handgrip assembly is movable between a collapsed position adjacent the cylindrical body and an extended position for grasping and holding of the apparatus, and wherein the entire outer surface of the cylindrical body except for the handgrip assembly includes foam material.

The body of the apparatus is typically made of plastic material and has an assembled length of about 10 to 50 inches and a diameter of about 5 to 10 inches with each support rod configured to support from about 2.5 to 25 pounds of donut weights, each donut weight preferably weighing 2.5 pounds.

In a most preferred embodiment, the exercise roller apparatus comprises an adjustable weighting component comprising two or more dumbbells or donut weights that provide additional weight of about 5 to 55 pounds to the apparatus; a rigid cylindrical body having a central partition with the body defining first and second unobstructed chambers to receive dumbbell(s) or donut weight(s) of the weighting component therein; a first removable end cap on one end of the cylindrical body, having one donut weight of the adjustable weighting component affixed thereto and including a rigid cylindrical support rod extending into the first chamber from the first end cap, with the support rod configured and dimensioned for holding a dumbbell or supporting additional donut weights in the first chamber to provide part of the adjustable weighting component; a second removable end cap on the other end of the cylindrical body, having one donut weight of the adjustable weighting component affixed thereto and including a rigid cylindrical support rod extending into the second chamber from the second end cap, with the support rod configured and dimensioned for holding a dumbbell or supporting additional donut weights in the second chamber to provide a remaining part of the adjustable weighting component; and two handgrip assemblies affixed to the cylindrical body in a linearly aligned and spaced arrangement such that the entire weight of the apparatus may be supported by a user gripping the handgrip assemblies, wherein each handgrip assembly is movable between a collapsed position adjacent the cylindrical body and an extended position for grasping and holding of the apparatus. The entire outer surface of the cylindrical body except for the handgrip assembly includes foam material. Also, the exercise roller apparatus has an assembled length of about 10 to 50 inches and a diameter of about 5 to 10 inches, and each cylindrical support rod is configured and dimensioned to fit within the rigid cylindrical body and support about 5 to 25 pounds of additional weight.

One aspect of the preferred embodiment has each end cap including two spaced catches with the cylindrical body including four correspondingly spaced recesses, two for each end cap. Each recess includes a draw latch for removable connection of the end caps to the cylindrical body by engagement of the latches and catches. The foam material covers the entire outer surface of the cylindrical body except for the handgrips and recesses.

Another aspect of the preferred embodiment has each end cap threadedly engaged with the end of the cylindrical body, with the adjustable weighting component including two dumbbells, one in each chamber with the support rod holding the dumbbell in place in the respective chamber.

For either embodiment, wherein each chamber preferably includes an equal part of the weighting component and wherein each end cap has an outer cylindrical surface also includes foam material.

The invention also relates to a kit for transporting and assembling the exercise roller apparatus. The kit includes the various parts that can be assembled with the desired amount of weight to conduct exercise activities.

The features and advantages of the present invention will become apparent from the subsequent detailed description of the preferred embodiment and the appended claims taken in conjunction with the accompanying drawings.

BRIEF DESCRIPTION OF THE DRAWINGS

Preferred and non-limiting features of the invention will now be described in connection with the appended drawing figures, wherein:

FIG. 5-8 illustrate the donut weights of the invention, wherein:

FIG. 5 shows a cross-section of a side-view of the donut weight.

FIG. 6 shows the underside of the donut weight.

FIG. 7 shows a side-view of the donut weight.

FIG. 8 shows a top view of the donut weight.

DETAILED DESCRIPTION OF THE PREFERRED EMBODIMENTS

As noted herein, the present invention is directed to an improved exercise roller apparatus comprising a cylindrical tube having at least one unobstructed or hollow inner compartment and wrapped in a foam sleeve. The hollow compartment(s) are used to hold an adjustable weighting component comprising one or more dumbbells or donut weights that provide additional weight of about 2.5 to 55 pounds to the apparatus. The end caps can hold or maintain the weights in a fixed position such that the weights do not shift while the roller is in use and the roller rolls steadily on a smooth surface. The outer foam sleeve provides the necessary cushioning to comfortably roll the body over the roller during therapeutic roller use or roller-aided exercises. At least one removable handgrip are provided on the roller in order to transform the roller into a weight-lifting device. For example, two handgrips may be affixed to the roller such that the handgrips are oriented in a linear, spaced alignment so that they can be grasped by a user in order to lift the roller during weight training exercises, such as deadlifts or core-strengthening exercises.

The present invention aims to provide users with a broad range of exercise options as well as easy portability. In particular, the present invention aims to provide portable whole body exercise tools for multiple purpose use as a core fitness development apparatus, an accessory to general fitness, and a therapeutic and/or rehabilitative aid. As mentioned above, such an apparatus can aid with general stretching, body rolling, and balance training, while also including features that enable users to perform muscle-building exercises, such as deadlifts and weight-assisted core exercises, or specific sports-related exercises, such as golf exercises, tennis exercises, volleyball exercises, or sailing exercises. This is accomplished by providing an exercise roller with the following features:

- at least one storage compartment for securely holding removable weights;
- quick and easy disassembly or adjustment to the desired weight;
- effectively used for therapeutic purposes as well as intensive weight training;
- easily and comfortably carried and transported (i.e., is configured and dimensioned to fit within and/or attach to a gym bag, backpack, or travel bag);
- can be made of a variety of materials (e.g., PVC body and foam);
- can include features to increase users' comfort (e.g., foam sleeves of variable hardness); and
- is cost-effective from both a manufacturer's and consumer's point of view.

Figure 1:
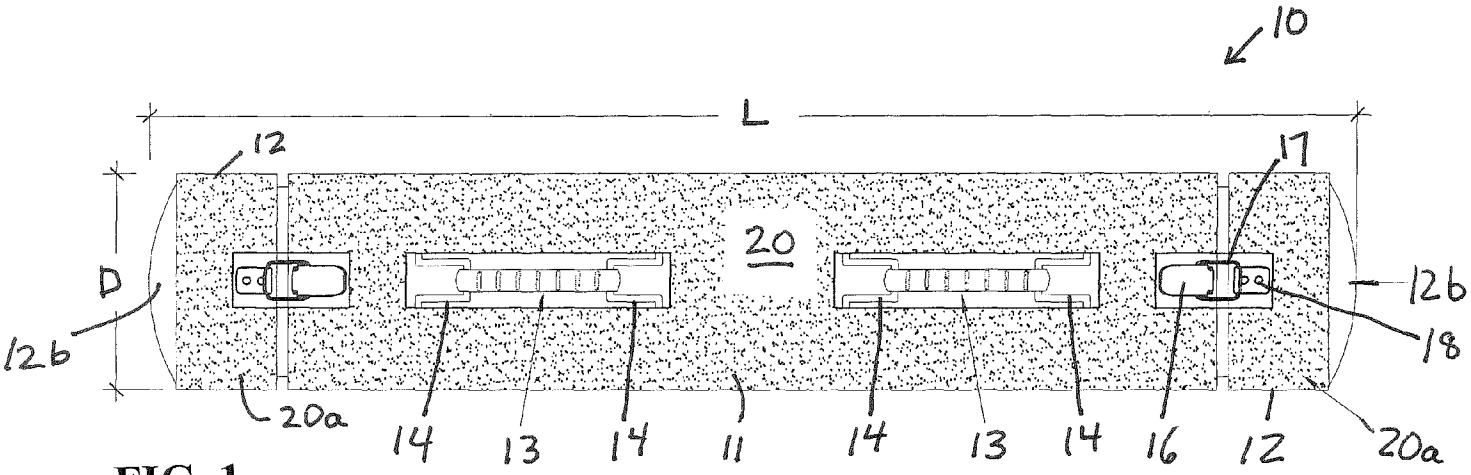
FIG. 1 is a top view of the apparatus of the present invention.
Figure 2:
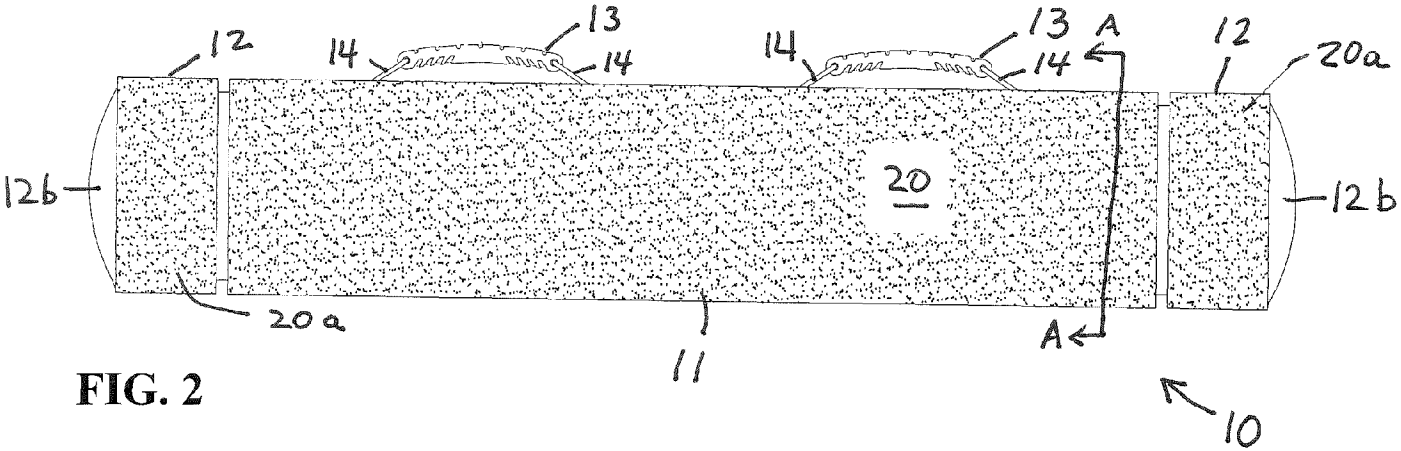
FIG. 2 is a side view of the apparatus of FIG. 1.
Figure 3:
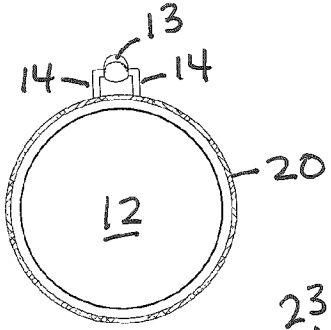
FIG. 3 is an end view of the apparatus of FIG. 1 taken along lines A-A of FIG. 2.

Referring now to the figures, wherein like numbers represent like elements, FIGS. 1-3 show exterior views of one embodiment of the present invention. FIG. 1 is an exterior top-view of the present invention showing the exercise roller 10 in fully assembled form, while FIG. 2 is an exterior side-view of the same embodiment of present invention in fully assembled form. FIG. 3 is an end view to show end cap 12. Both figures show that the exercise roller 10 is of a cylindrical shape of length L, ranging from 10 to 40 inches, and diameter D, ranging from 5 to 10 inches. The exercise roller itself comprises a cylindrical body 11 with removable end caps 12 on both ends of the cylindrical body 11, as shown. The end caps 12 have a domed end surface to provide a smooth, aesthetic appearance, and a cylindrical side.

The exercise roller 10 may be carried or lifted during exercise by handgrips 13 which are fastened to the exercise roller through slide clips 14. The slide clips 14 are preferably configured to allow the handle to be movable between a collapsed position where the handgrips 13 are placed adjacent the cylindrical body, and an extended position as shown for grasping and holding of the apparatus. The collapsed position allows the roller to roll along the floor without the handles causing any interruption in rolling movement. Of course, the entire outer surface of the cylindrical body except for the handgrip assemblies includes a layer of foam material to facilitate use of the device as a roller. The cylindrical sides of the end caps 12 also are provided with foam. When the handle 13 is in the expanded position, exercises such as deadlifts may be performed by lifting the exercise roller 10 by the handgrips 13.

The exercise roller's cylindrical body 11 and removable end caps 12 are preferably made of a hard but relatively lightweight material, such as a plastic, e.g., PVC, to resist deformation or damage from use, particularly because of the toughness required to house and carry the removable weights as well as withstand the weight of the user during rolling exercises. The end caps may be configured with a rounded top 12*b* for aesthetic purposes as well as to avoid a sharp corner. The exercise roller further comprises a thin layer of a foam material 20 surrounding the cylindrical body 11 as well as additional foam material 20*a* on the cylindrical side 12*a* of each end cap 12. Any foam material can be used, ranging from those made of various softer or harder materials (e.g., various foam materials of different densities or thicknesses) depending on the desired cushioning effect. A polyurethane foam having a density of between 1.8 and 3.2 pounds per cubic foot is preferred but other foams having a similar density would also be suitable. The foam material may be applied to the body as a layer that is adhered thereto. Alternatively, the foam material can be configured as a sleeve or tube which is slid over the body for engagement thereto. Preferably, the weight of a fully assembled exercise roller apparatus, without any additional removable weights inside, does not exceed 20 pounds and typically is around 5 to 10 pounds.

FIG. 3 also shows the handle 13 and attachment clips 14 extending above the body 11. The handgrip 13 is configured and dimensioned to comfortably fit the average hand of the targeted user (e.g., average female hand, average male hand, etc.).

Figure 4:
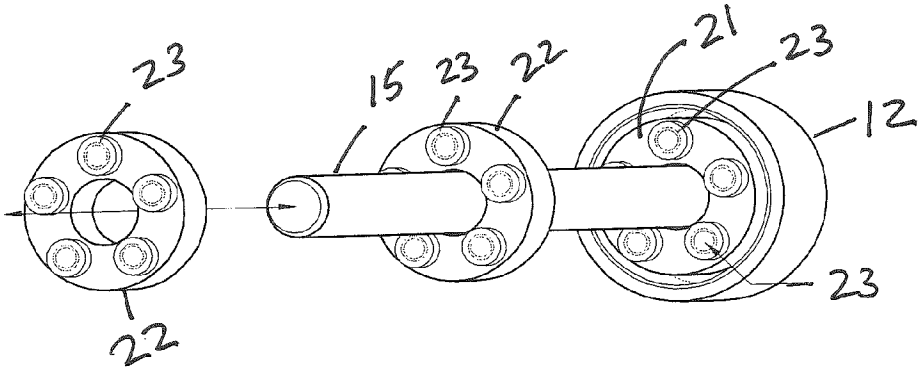
FIG. 4 is a side view of the end cap illustrating the attachment of donut weights.
Figure 8:
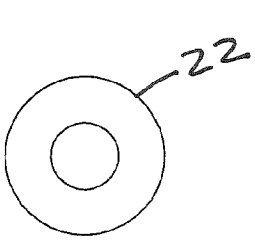
Figure 7:
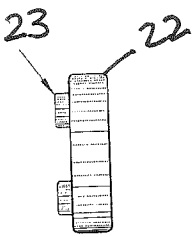
Figure 6:
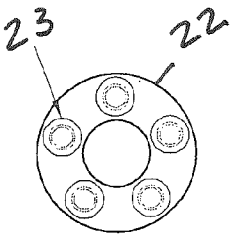
Figure 5:
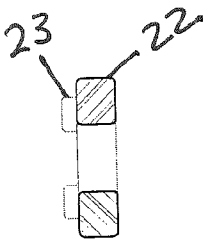

FIG. 4 illustrates the support rod 15 which is attached to the interior of the removable end cap 12. This rod 15 receives donut weights 22. One of the donut weights 22 is fixed to the inside of the end cap 12 to increase the weight of the apparatus when used for lifting exercises. The fixed donut weight also serves as an end support for the remaining weights. The other donut weights 22 are simply slid along the center support rod 15 into place.

To be held against the end weight, the end face 21 of the donut weights 22 are preferably studded or otherwise provided with magnets 23 or are fully or partially magnetized (see e.g., U.S. Pat. No. 7,216,508) on the inwardly facing side of the weight (i.e., the side which faces away from the end cap). The magnets 23 allow additional weights 22 to be held in place near the end of the cap 12 next to the donut weight that is fixed thereto so that the additional donut weights 22 do not move around in the apparatus during transport or use. Although 5 magnets are shown this is not a critical number and any number between 2 and 10 can be used as desired. Generally the greater weight donuts will require a greater number or larger size of magnets.

The additional donut weights 22 are simply slid upon the support rod 15 where they can be moved toward and be magnetically attached to or otherwise maintained in position next to the fixed donut weight. Each donut weight 22 preferably may weigh between 1 and 10 pounds but preferably weighs 2.5 pounds, and the user can determine how many to include depending upon the weight of the donut and the overall weight of the device that is needed for their exercises.

The end caps 12 may be removably attached to the cylindrical body 11 in any one of a variety of ways. As shown in FIGS. 1, 2, 9 and 10, a snap locking device can be used. Typically two snap locks are provided on opposite sides of the body member. These locks are provided in a recessed area on the body 11 and the end cap 12 with a draw latch 16 and associated loop 17 mounted in the recess on the body 11 and a mating catch 18 provided on the end cap in line with the draw latch and loop.

Figure 9:
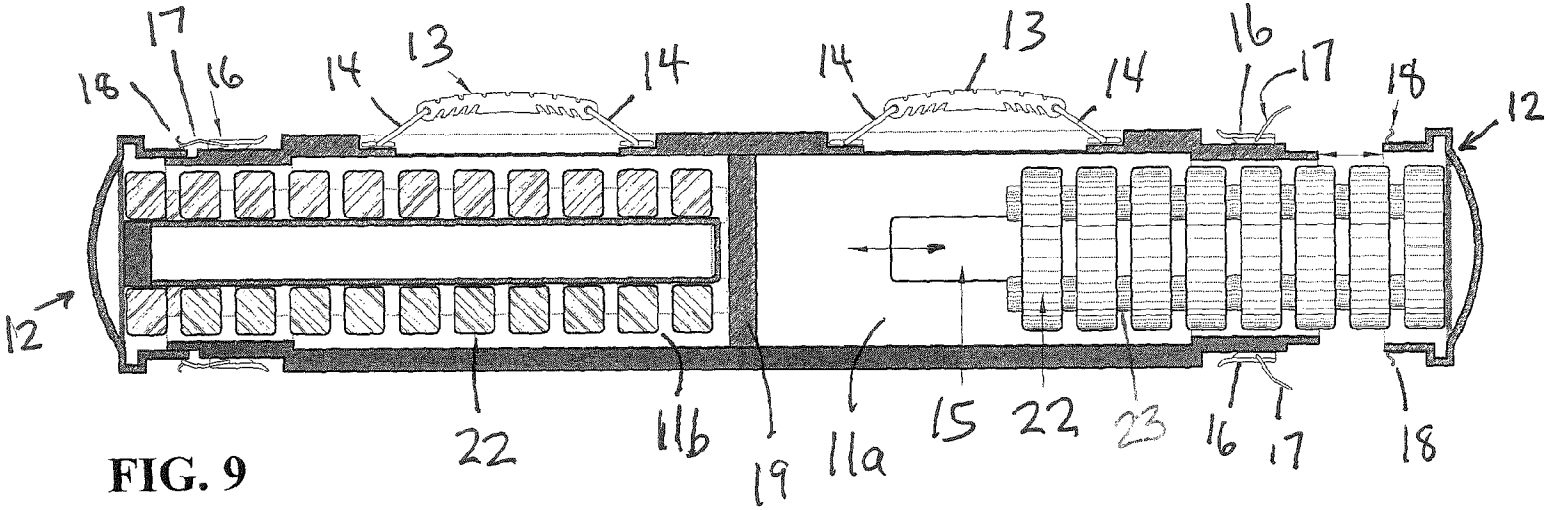
FIG. 9 shows a cross sectional side view of the apparatus of FIG. 1.
Figure 10:
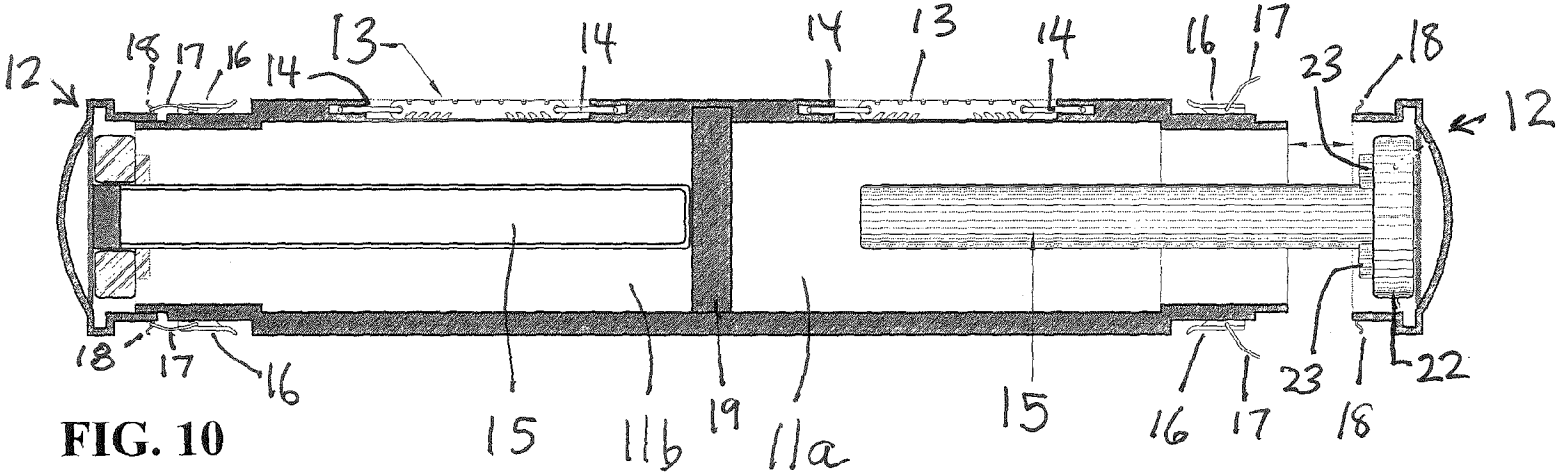
FIG. 10 shows a cross sectional side view of the apparatus of FIG. 9 with the donut weights removed to illustrate the center rod that supports the donut weights.

FIGS. 9-10 are cross sectional views that provide further details regarding the snap connection of the end caps 12 and the arrangement of the donut weights 22 in the body 11. Also shown in the internal partition 19 which separates the chamber into first 11*a* and second 11*b* chambers. In FIG. 9, the snap connection is shown in an open position for the end cap that is to be removably connected to body 11 to close off chamber 11*a*, while at the other end of the body, the snap connection is shown in a closed position for attaching the end cap to the body to close off chamber 11*b*. FIG. 9 also shows the use of 7 additional weights in chamber 11*a* and 10 additional weights in chamber 11*b*. Chamber 11*b* is full such of the weights such that no more can be added, which represented the maximum weight that can be provided by the device. Chamber 11*a* does have more room so that the user can add further weight as they develop their strength and conditioning.

FIG. 10 shows the support rods 15 without the addition of the weights except for the weights that are affixed to the end caps 12. FIG. 10 also shows the handle 13 and attachment clips 14 in the collapsed position so that the device can be rolled along the floor without interference from the handle. If course, the arrangement can have a slight locking aspect to it so that movement of the device does not cause the handle to become dislodged from the collapsed position.

Figure 11:
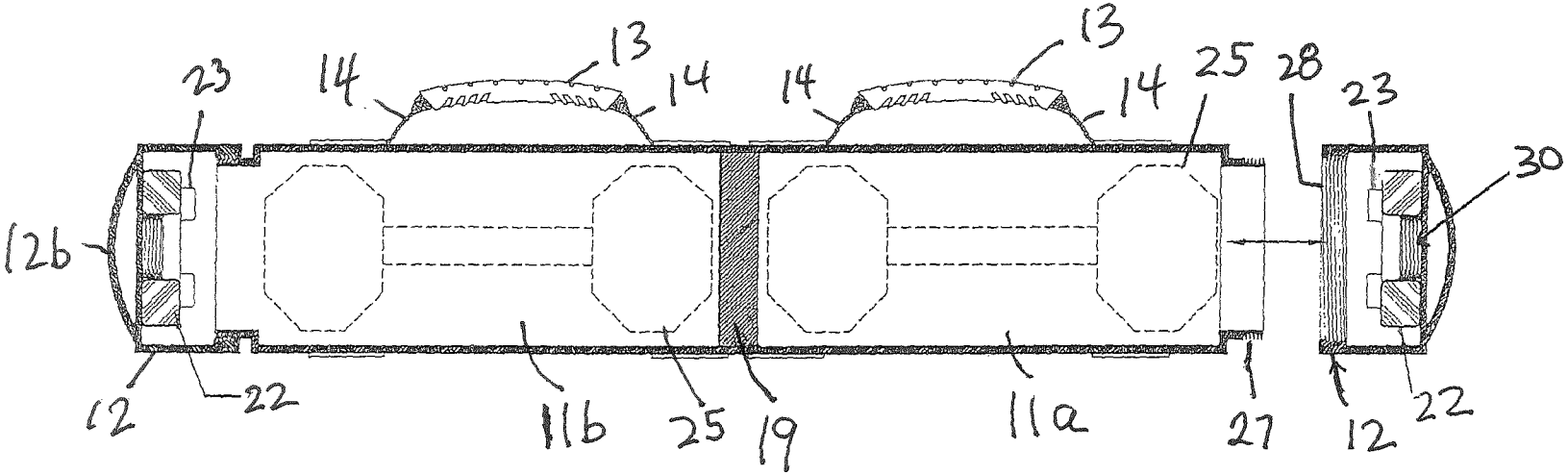
FIG. 11 shows the device with internal dumbbells as the adjustable weighting component.

FIG. 11 shown the use of free weights or dumbbells 25 in the chambers 11*a*, 11*b* rather than the donut weights. Also shown is the use of a threaded connection to secure the end cap 12 onto the body 11. The body includes a shoulder portion that is provided with threads 27 which are configured to mate with the threads 28 on the interior surface of the cylindrical portion of the end cap 12. Alternatively, a press fit connection is possible but the screw threads provide the most secure attachment of the end cap to the body to maintain the free weights therein. After the dumbbell 25 of the desired weight is placed into the chamber, the end caps are screwed onto the body to secure the weights therein.

Figure 12:
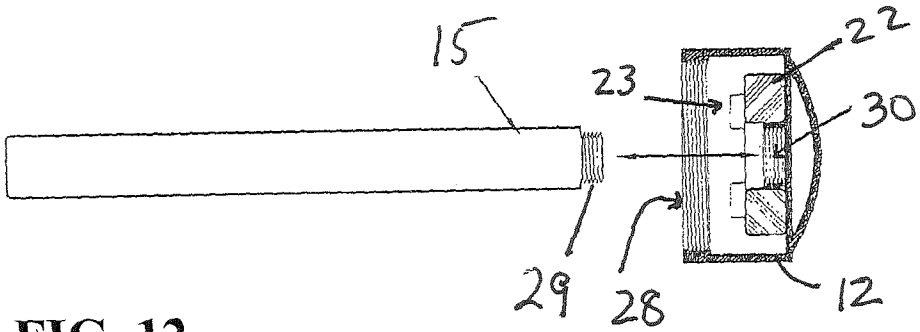
FIG. 12 illustrates one way to attach the center rod to the end cap.

To allow the end cap to be attached to the body, the support rod 15 is first removed. To allow such removal, the support rod 15 is removably attached to the end cap by providing a threaded end 29 of the rod 15 for engagement with the threaded opening 30 of the end cap 12 as shown in FIG. 12. Alternatively, a twist lock or clamp connector can be used to removably receive the support rod 15. The end cap 12 can receive a smaller rod or post which can be sized to contact the dumbbell 25 and urge it against partition 19 so that it does not move about in the chamber during use. This smaller rod or post can screw into the end cap in the same manner as the support rod 15.

Alternatively, the interior of the chamber can be designed to accept the weights in a way that restricts their movement, such as a conforming or friction fit of the dumbbells in the chamber. When the user wished to return to the use of donut weights, the center support rod 15 may be connected to the end cap 12 to provide a guide and support for the additional removable donut weights 22.

Preferably, the weight of a fully assembled exercise roller apparatus, including additional removable weights inside, does not exceed 100 pounds and is typically around 40 to 60 pounds for most users. By adding or removing such weights, the overall weight of the apparatus can be changed to accommodate the abilities of the user.

A carry strap (not shown) may also be affixed to the exercise roller apparatus in a way similar to the removable handgrips, or it may be removably affixed to the handgrips themselves. Such a strap would allow for easy portability of the exercise roller.

In an alternative embodiment, rather than have a dual chamber cylinder with a central partition, two separate chambers can be provided. These two chambers can be joined by male and female portions typically being press-fit together or by having screw male and female mating screw threads. The ends that are joined together can include internal partitions so that the cylinder end is closed when the two halves are not connected. This allows the user to create two weighted half cylinders, each of which is provided with a hand grip so that they can be lifted or manipulated separately with each hand or arm. The internal weights can be the same as described previously. Alternatively, additional end caps can be provided to close off the open ends when the two halves are separated. And when the hand grips are removed, two separate rollers are provided for use, e.g., individually with each leg.

While there has been shown and described what are considered to be preferred embodiments of the invention, it will of course be understood that various modifications and changes in form or detail could readily be made without departing from the spirit of the invention. It is therefore intended that the invention not be limited to the exact form and detail herein shown and described, nor to anything less than the true spirit and scope of the invention as hereinafter claimed.

What is claimed is:

1. An exercise roller apparatus comprising:

an adjustable weighting component comprising a dumbbell or donut weights that provide a total weight of 2.5 to 55 pounds to the apparatus;

a rigid cylindrical body defining an unobstructed chamber configured and dimensioned to receive the one or more dumbbells or donut weights therein;

a foam material surrounding at least a portion of the cylindrical body; and a first end cap removably connected to one end of the cylindrical body;

wherein the first end cap houses a first donut weight and includes a rigid cylindrical support rod removably attached thereto, the support rod, when attached to the end cap, extending into the chamber from the end cap, with the support rod configured and dimensioned for supporting additional donut weights of the adjustable weighted component in the chamber.

2. The exercise roller apparatus according to claim 1, further comprising a second end cap on the other end of the cylindrical body, wherein the second end cap houses a second donut weight and includes a rigid cylindrical support rod removably attached thereto, the support rod, when attached to the end cap, extending into the chamber from the end cap, with the support rod configured and dimensioned for supporting additional donut weights in the chamber so that the adjustable weighting component provides additional weight of at least 5 pounds to the apparatus wherein the additional donut weights amount to the total weight of the adjustable weighting component.

3. The exercise roller apparatus according to claim 2, wherein the first and second end caps each have the respective first and second donut weights affixed thereto, and one or more donut weights includes a selectable plurality of donut weights, each of which includes one or more magnets on an outer surface thereof so that the donut weights are magnetically attracted to each other to hold the weights against the end cap, with the donut weights provided on the support rod of the first end cap, the support rod of the second end cap or on both support rods.

4. The exercise roller apparatus according to claim 3, wherein the body is made of plastic material and has an assembled length of 10 to 50 inches and a diameter of 5 to 10 inches with each of the support rods configured to support from 2.5 to 25 pounds of donut weights, each of the donut weights weighing 2.5 pounds.

5. The exercise roller apparatus according to claim 2 further comprising a central partition that divides the chamber into first and second unobstructed chambers with each end of the body including one of the first or second removable end caps that house the respective first and second donut weights and the support rods, respectively, extending into the chamber from the respective end caps, wherein an entire outer surface of the cylindrical body includes a foam material.

6. The exercise roller apparatus of claim 2, wherein one or both of the end caps are threadedly engaged with the end of the cylindrical body, and wherein, when the support rod is removed from one or both end caps, the adjustable weighting component includes one or two dumbbells in the chamber.

7. The exercise roller apparatus according to claim 1, wherein the first end cap includes two spaced catches and the cylindrical body includes two correspondingly spaced recesses each with a draw latch for removable connection of the first end cap to the cylindrical body by engagement of the latches and catches, wherein the entire outer surface of the cylindrical body except for the recesses includes foam material.

8. The exercise roller apparatus according to claim 1 further comprising at least one handgrip assembly affixed to the cylindrical body such that the entire weight of the apparatus may be supported by a user gripping the handgrip assembly, wherein the handgrip assembly is movable between a collapsed position adjacent the cylindrical body and an extended position for grasping and holding of the apparatus, and wherein the entire outer surface of the cylindrical body except for the handgrip assembly includes foam material.

9. A kit for transporting and assembling the exercise roller apparatus of claim 1 comprising:

the rigid cylindrical body and foam material sleeve;

the at least one removable end cap having the first donut weight affixed thereto and the rigid cylindrical support rod; and the adjustable weighting component includes either (a) the dumbbell or (b) between one and ten removable donut weights, each donut weight weighing 2.5 pounds.

10. An exercise roller apparatus comprising:

an adjustable weighting component comprising two or more dumbbells and two donut weights that provide additional weight so that the apparatus has a total weight of about 5 to 55 pounds;

a rigid cylindrical body having a central partition with the body defining first and second unobstructed chambers to receive the dumbbells therein;

a first end cap removably connected to one end of the cylindrical body, having one of the two donut weights of the adjustable weighting component affixed thereto;

a second end cap removably connected to the other end of the cylindrical body, having the other donut weight of the adjustable weighting component affixed thereto; and two handgrip assemblies affixed to the cylindrical body in a linearly aligned and spaced arrangement such that the entire weight of the apparatus may be supported by a user gripping the handgrip assemblies, wherein each handgrip assembly is movable between a collapsed position adjacent the cylindrical body and an extended position for grasping and holding of the apparatus;

wherein the entire outer surface of the cylindrical body except for the handgrip assembly includes foam material; and wherein the exercise roller apparatus has an assembled length of 10 to 50 inches and a diameter of 5 to 10 inches.

11. The exercise roller apparatus according to claim 10, wherein each end cap includes two spaced catches and the cylindrical body includes four correspondingly spaced recesses, two for each end cap, each recess including a draw latch for removable connection of the end caps to the cylindrical body by engagement of the latches and catches, wherein the foam material on the entire outer surface of the cylindrical body does not cover the recesses.

12. The exercise roller apparatus of claim 10, wherein each end cap is threadedly engaged with the end of the cylindrical body, and wherein the adjustable weighting component includes two dumbbells, one in each chamber with the end cap assisting in holding the dumbbell in place in the respective chamber.

13. The exercise roller apparatus of claim 10, wherein each chamber includes an equal part of the weighting component and wherein each end cap has an outer cylindrical surface that includes foam material.

14. A kit for transporting and assembling the exercise roller apparatus of claim 10 comprising:

the rigid cylindrical body and foam material sleeve;

the first and second removable end caps having the first and second donut weight, respectively, affixed thereto; and one or more dumbbells.

15. An exercise roller apparatus comprising:

an adjustable weighting component comprising a dumbbell or donut weights that provide a total additional weight of 2.5 to 55 pounds to the apparatus;

a rigid cylindrical body defining an unobstructed chamber configured and dimensioned to receive the one or more dumbbells or donut weights therein;

a foam material surrounding at least a portion of the cylindrical body; and a first end cap removably connected to one end of the cylindrical body;

wherein the first end cap houses a first donut weight and includes a rigid cylindrical support rod that is removably attached thereto;

wherein the support rod, when attached to the end cap, is configured and dimensioned to extend into the chamber from the end cap to support additional donut weights in the chamber in order to provide a desired weight for the adjustable weighting component; and wherein the rigid cylindrical body, when the support rod is removed from the end cap, is configured to receive the dumbbell therein with the donut weight in the end cap assisting in holding the dumbbell in place in the chamber in order to provide a different desired weight for the adjustable weighting component.

16. The exercise roller apparatus according to claim 15, further comprising a second removable end cap on the other end of the cylindrical body, wherein the second end cap houses a second donut weight and includes a rigid cylindrical support rod that is removably attached thereto;

wherein the support rod, when attached to the end cap, is configured and dimensioned to extend into the chamber from the end cap to support additional donut weights in the chamber in order to provide a desired weight for the adjustable weighting component; and wherein the rigid cylindrical body, when the support rod is removed from the end cap, is configured to receive a second dumbbell therein with the donut in the end cap assisting in holding the dumbbell in place in the chamber in order to provide a different desired weight for the adjustable weighting component.

17. The exercise roller apparatus according to claim 16 further comprising a central partition that divides the chamber into first and second unobstructed chambers, wherein each of the first and second end caps are threadedly engaged with the ends of the cylindrical body and wherein the entire outer surface of the cylindrical body includes foam material.

18. The exercise roller apparatus according to claim 16, wherein each of the first and second end caps includes two spaced catches and the cylindrical body includes four correspondingly spaced recesses, two for each of the respective end caps, each of the recesses including a draw latch for removable connection of the end caps to the cylindrical body by engagement of the latches and catches, wherein the foam material on the entire outer surface of the cylindrical body does not cover the recesses.

19. The exercise roller apparatus according to claim 16 further comprising at least one handgrip assembly affixed to the cylindrical body such that the entire weight of the apparatus may be supported by a user gripping the handgrip assembly, wherein the handgrip assembly is movable between a collapsed position adjacent the cylindrical body and an extended position for grasping and holding of the apparatus, and wherein the entire outer surface of the cylindrical body except for the handgrip assembly includes foam material.

20. A kit for transporting and assembling the exercise roller apparatus of claim 15 comprising:

the rigid cylindrical body and foam material sleeve;

the first removable end cap having the first donut weight affixed thereto and the rigid cylindrical support rod; and either (a) one or more dumbbells or (b) between one and ten removable donut weights, each donut weight weighing 2.5 pounds.

* * * * *